US009745821B2

(12) United States Patent
Twardowski et al.

(10) Patent No.: US 9,745,821 B2
(45) Date of Patent: Aug. 29, 2017

(54) METHOD AND APPARATUS FOR SEALING TUBULARS

(71) Applicant: Weatherford Technology Holdings, LLC, Houston, TX (US)

(72) Inventors: Eric M. Twardowski, Spring, TX (US); Albert C. Odell, II, Kingwood, TX (US); Tuong Thanh Le, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 378 days.

(21) Appl. No.: 14/152,937

(22) Filed: Jan. 10, 2014

(65) Prior Publication Data

US 2014/0196900 A1 Jul. 17, 2014

Related U.S. Application Data

(60) Provisional application No. 61/751,887, filed on Jan. 13, 2013.

(51) Int. Cl.

| | |
|---|---|
| ***E21B 17/04*** | (2006.01) |
| ***E21B 33/14*** | (2006.01) |
| ***E21B 33/10*** | (2006.01) |
| ***E21B 7/20*** | (2006.01) |
| ***E21B 21/10*** | (2006.01) |

(52) U.S. Cl.

CPC ..... *E21B 33/14* (2013.01); *E21B 7/208* (2013.01); *E21B 21/103* (2013.01); *E21B 33/10* (2013.01)

(58) Field of Classification Search

CPC ..... F16J 15/02; F16J 15/021; F16J 15/008; E21B 17/02; E21B 17/04; E21B 17/07; E21B 17/08; E21B 17/085

See application file for complete search history.

(56) References Cited

U.S. PATENT DOCUMENTS

| | | | | |
|---|---|---|---|---|
| 2,121,051 A | | 6/1938 | Ragan et al. | |
| 2,263,566 A | | 11/1941 | Boynton | |
| 2,998,085 A | * | 8/1961 | Dulaney | E21B 4/14 175/100 |
| 3,398,760 A | * | 8/1968 | Boyd et al. | 137/155 |
| 3,570,603 A | | 3/1971 | Kammerer, Jr. et al. | |
| 3,797,864 A | * | 3/1974 | Hynes et al. | 324/366 |

(Continued)

FOREIGN PATENT DOCUMENTS

| | | |
|---|---|---|
| WO | 9928586 A1 | 6/1999 |
| WO | 2004013456 A1 | 2/2004 |

OTHER PUBLICATIONS

PCT International Search Report and Written Opinion dated May 8, 2015, for International Application No. PCT/US2014/011338.

(Continued)

*Primary Examiner* — Kipp Wallace

(74) *Attorney, Agent, or Firm* — Patteson & Sheridan, LLP

(57) ABSTRACT

A method of controlling fluid flow between two tubulars includes disposing a sealing member in an annular area between two tubulars, wherein the two tubulars partially overlap; moving the sealing member to a lower position where it is not in contact with one of the tubulars, thereby allowing fluid flow through the annular area; and moving the sealing member to an upper position where it is in contact with both of the tubulars, thereby preventing fluid flow through the annular area.

11 Claims, 9 Drawing Sheets

(56) References Cited

U.S. PATENT DOCUMENTS

| | | | | |
|---|---|---|---|---|
| 5,056,609 | A * | 10/1991 | Rear | 175/296 |
| 5,687,792 | A * | 11/1997 | Rodger et al. | 166/327 |
| 6,276,455 | B1 * | 8/2001 | Gonzalez | 166/357 |
| 6,382,319 | B1 * | 5/2002 | Hill, Jr. | E21B 43/045 166/194 |
| 8,657,007 | B1 * | 2/2014 | Watson et al. | 166/301 |
| 2004/0112644 | A1 * | 6/2004 | Chan | E21B 17/07 175/57 |
| 2005/0253340 | A1 * | 11/2005 | Ramsay | 277/559 |
| 2007/0084603 | A1 | 4/2007 | Livingstone | |
| 2009/0294177 | A1 * | 12/2009 | Chan | E21B 17/18 175/57 |
| 2011/0266752 | A1 * | 11/2011 | Kocurek | F16J 15/106 277/322 |

OTHER PUBLICATIONS

Australian Examination Report dated Jan. 12, 2016, for Australian Patent Application No. 2014205105.

* cited by examiner

METHOD AND APPARATUS FOR SEALING TUBULARS

BACKGROUND OF THE INVENTION

Field of the Invention

The present invention generally relates to an apparatus and method for casing drilling. More particularly, the invention relates to apparatus and methods for sealing between two tubulars.

Description of the Related Art

In the oil and gas producing industry, the process of cementing casing into the wellbore of an oil or gas well generally comprises several steps. For example, a conductor pipe is positioned in the hole or wellbore and may be supported by the formation and/or cemented. Next, a section of a hole or wellbore is drilled with a drill bit which is slightly larger than the outside diameter of the casing which will be run into the well.

Thereafter, a string of casing is run into the wellbore to the required depth where the casing lands in and is supported by a well head in the conductor. Next, cement slurry is pumped into the casing to fill the annulus between the casing and the wellbore. The cement serves to secure the casing in position and prevent migration of fluids between formations through which the casing has passed. Once the cement hardens, a smaller drill bit is used to drill through the cement in the shoe joint and further into the formation.

Recently developed drilling with casing systems, such as Weatherford International's SeaLance™ system, a retrievable drilling motor is utilized to rotate the lower end of the casing string (or shoe track) independently of the remainder of the casing string. Due to the likelihood of misalignment during the drilling and cementing processes, a clearance gap exists between the lower end of the non-rotating casing string and the upper end of the rotating shoe track.

During drilling operations, it may be acceptable for a portion of the drilling fluid to leak through this gap, as fluid travels from the inside of the casing, through the gap, and into the annulus. Likewise, while pumping the cement slurry, it is acceptable for a portion of the cement slurry to leak through this gap, as it flows from the inside of the casing, through the gap, and into the annulus.

After pumping has stopped, it is important to prevent the cement slurry from u-tubing or flowing back from the annulus and into the inside of the casing. If this were to happen, a poor quality cement job could result. In addition, the retrievable drilling motor could become inadvertently cemented in place.

There is a need, therefore, for a reliable sealing mechanism that could effectively seal the gap between the shoe track and the casing string, when pumping stops.

SUMMARY OF THE INVENTION

Embodiments of the present invention provide a sealing mechanism for sealing between two tubulars.

In one embodiment, a method of controlling fluid flow between two tubulars includes disposing a sealing member in an annular area between two tubulars; moving the sealing member to a lower position where it is not in contact with one of the tubulars, thereby allowing fluid flow through the annular area; and moving the sealing member to an upper position where it is in contact with both of the tubulars, thereby preventing fluid flow through the annular area.

In another embodiment, a sealing assembly includes: a first tubular having a recess; a second tubular having a raised portion and partially overlapping the first tubular; a sealing member disposed in the recess and between the first tubular and the second tubular, wherein the sealing member is movable in the recess between a lower position and an upper position, where in the upper position, the sealing member is in contact with the raised portion to prevent fluid flow through between the tubulars, and where in the lower position, the sealing member is not in contact with the raised portion to allow fluid flow between the tubulars.

In another embodiment, a valve arrangement in a tubular includes a first one way valve configured to prevent fluid flow in the tubular in a first direction; and a second one way valve configured to prevent fluid flow in the tubular in a second, opposite direction.

In another embodiment, a method of completing a wellbore includes providing a tubular having a first one way valve configured to prevent fluid flow in the tubular in a first direction and a second one way valve configured to prevent fluid flow in the tubular in a second, opposite direction; supplying a cement through the first and second valves and out of the tubular; closing the second one way valve to prevent cement from returning into the tubular; and closing the first one way valve and applying pressure above the first one way valve.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally relates to a subsea casing drilling system. In one embodiment, the system includes a conductor casing coupled to a surface casing and the coupled casings can be run concurrently. In one trip, the system will jet-in the conductor casing and a low pressure wellhead housing, unlatch the surface casing from the conductor casing, drill the surface casing to target depth, land a high pressure wellhead housing, cement, and release. The drillable casing bit may be powered by a retrievable downhole motor which rotates the casing bit independently of the surface casing string. In another embodiment, the system may also include the option of rotating the casing bit from surface.

An exemplary casing drilling method is disclosed in U.S. patent application Ser. No. 12/620,581, which application is incorporated herein by reference in its entirety.

An exemplary subsea casing drilling system is disclosed in U.S. provisional patent application Ser. No. 61/601,676

("the '676 application"), filed on Feb. 22, 2012, which application is incorporated herein by reference in its entirety.

The '676 application discloses an embodiment of a casing bit drive assembly suitable for use in a casing drilling system and method. The casing bit drive assembly includes one or more of the following: a retrievable drilling motor; a decoupled casing sub; a releasable coupling between the motor and casing bit; a releasable coupling between the motor and casing; a cement diverter; and a casing bit.

Figure 1A:
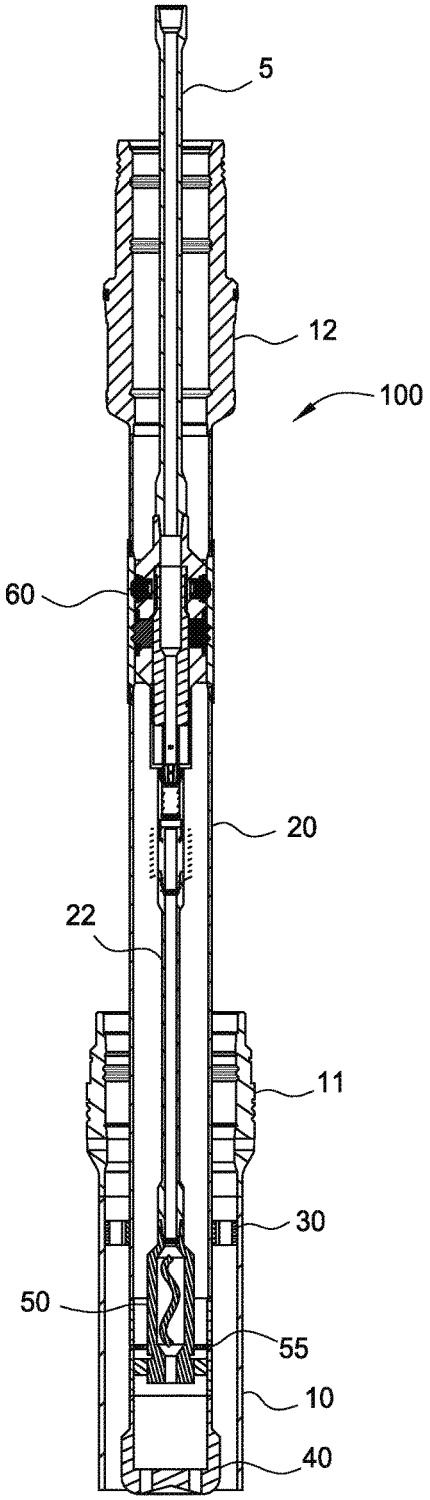
FIGS. 1A and 1B show an exemplary embodiment of a casing drilling system.
Figure 1B:
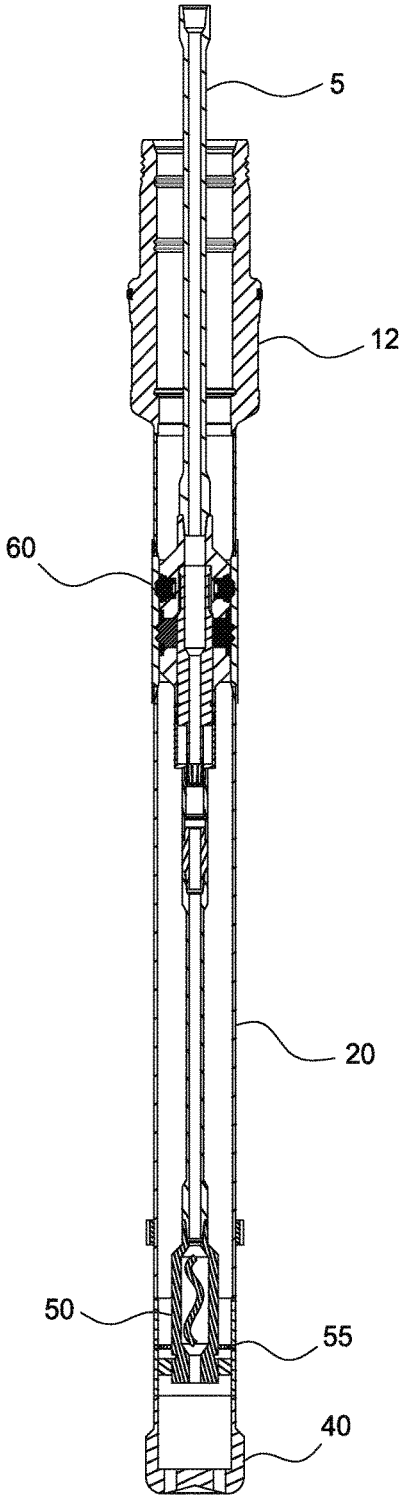

FIGS. 1A and 1B show an exemplary embodiment of a casing drilling system 100. The casing drilling system 100 includes a conductor casing 10 coupled to a surface casing 20 and the coupled casings 10, 20 may be run concurrently. The casings 10, 20 may be coupled using a releasable latch 30. A high pressure wellhead 12 connected to the surface casing 20 is configured to land in the low pressure wellhead 11 of the conductor casing 10. The drill string 5 and the inner string 22 are coupled to the surface casing 20 using a running tool 60. A motor 50 is provided at the lower end of the inner string 22 to rotate the casing bit 40. In another embodiment, the casing bit 40 may be rotated using torque transmitted from the surface casing 20. An optional swivel 55 may be included to allow relative rotation between the casing bit 40 and the surface casing 20. In operation, the casing drilling system 100 is run-in on the drill string 5 until it reaches the sea floor. The system 100 is then "jetted" into the soft sea floor until the majority of the length of the conductor casing 10 is below the mudline, with the low pressure wellhead housing 11 protruding a few feet above the mudline. The system 100 is then held in place for a time, such as a few hours, to allow the formation to "soak" or re-settle around the conductor casing 10. After "soaking", skin friction between the formation and the conductor casing 10 will support the weight of the conductor casing 10.

The releasable latch 30 is then deactivated to decouple the surface casing 20 from the conductor casing 10. In one embodiment, the surface casing 20 has a 22 inch diameter and the conductor casing 10 has a 36 inch diameter. After unlatching from the conductor casing 10, the surface casing 20 is drilled or urged ahead. The casing bit 40 is rotated by the downhole drilling motor 50 to extend the wellbore. The decoupled drilling swivel 55 allows the casing bit 40 to rotate independently of the casing string 20 (although the casing string may also be rotated from surface). Upon reaching target depth ("TD"), the high pressure wellhead 12 is landed in the low pressure wellhead housing 11. Since the casing string 20 and high pressure wellhead 11 do not necessarily need to rotate, drilling may continue as the high pressure wellhead 12 is landed, without risking damage to the wellhead's sealing surfaces.

After landing the wellhead 12, it is likely that the formation alone will not be able to support the weight of the surface casing 20. If the running tool 60 was released at this point, it is possible that the entire casing string 20 and wellhead 12 could sink or subside below the mudline. For this reason, the running tool 60 must remain engaged with the surface casing 20 and weight must be held at surface while cementing operations are performed. After cementing, the running tool 60 continues holding weight from surface until the cement has cured sufficiently to support the weight of the surface casing 20.

After the cement has cured sufficiently, the running tool 60 is released from the surface casing 20. The running tool 60, inner string 22, and drilling motor 50 are then retrieved to surface.

A second bottom hole assembly ("BHA") is then run in the hole to drill out the cement shoe track and the drillable casing bit 40. This drilling BHA may continue drilling ahead into new formation.

Figure 2:
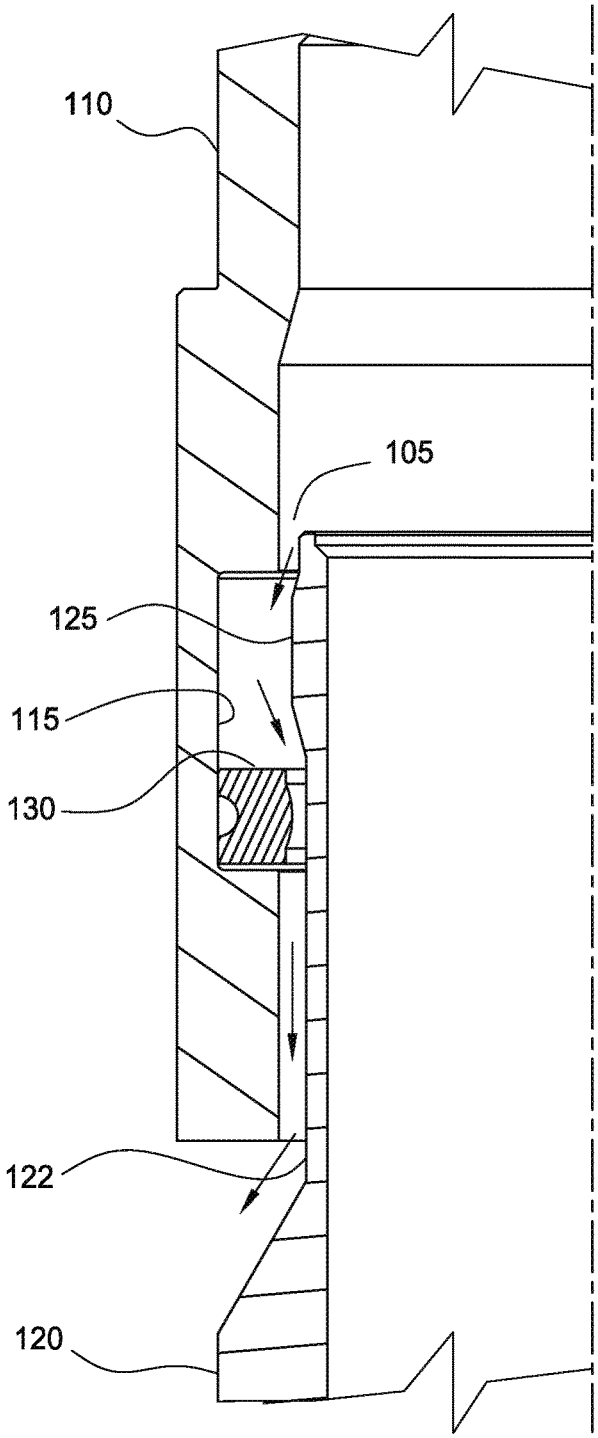
FIGS. 2-3 illustrate an embodiment of a sealing assembly for sealing between two tubulars.
Figure 3:
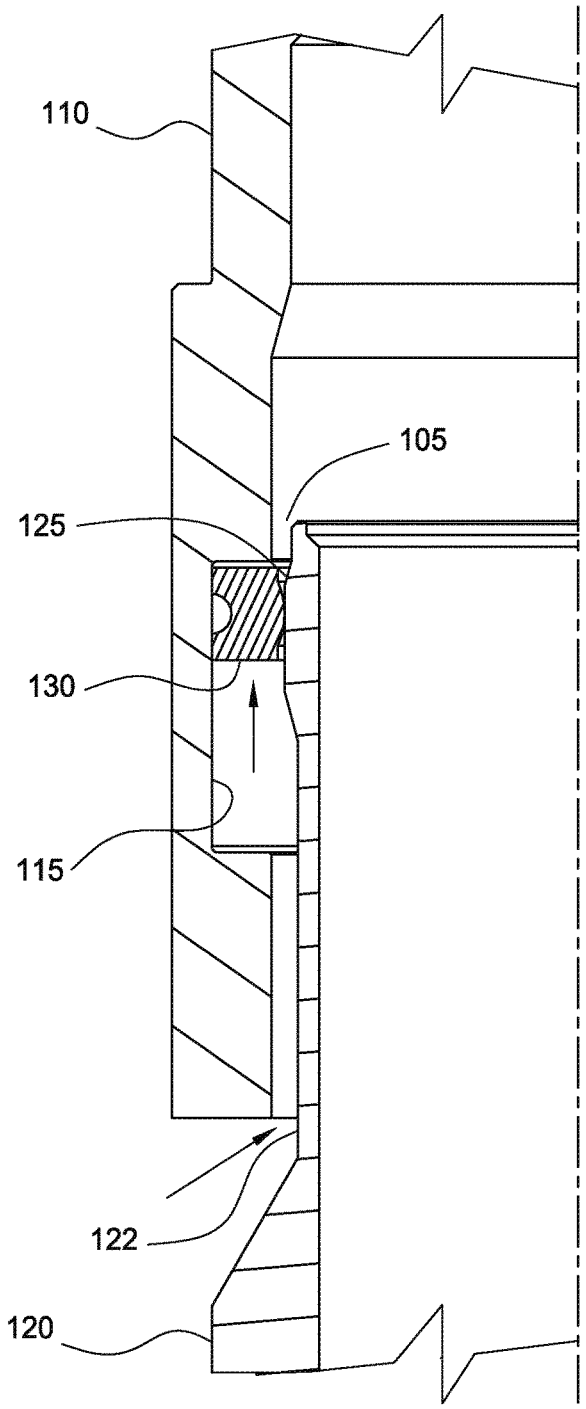

FIGS. 2 and 3 illustrate an enlarged cross-sectional view of the interface between the non-rotating casing string 110 and the rotating casing bit 120. It must be noted that a casing section may be attached to the casing bit to extend the length of the casing bit and the casing section may be rotatable with the casing bit. As seen in FIG. 2, a gap 105 exists between casing 110 and the casing bit 120. Embodiments of the sealing assembly of the present invention may be used to seal the gap 105 from fluid flow through the gap 105. It must be further noted that instead of a casing and a casing bit, embodiments of the seal assembly may be used to seal a gap between two tubulars, such as two casings or two tubings.

In FIG. 2, the lower end of the casing 110 partially overlaps the upper end of the casing bit 120. In one embodiment, an optional sleeve attached to casing 110 may be used to overlap the upper end of the casing bit 120. The interior surface of the casing 110 includes a recess 115 for retaining a sealing member 130. The outer surface of the upper end of the casing bit 120 includes a raised portion 125 and a non-raised portion 122. The length of the recess 115 is sufficiently sized such that it at least partially overlaps both the raised portion 125 and the non-raised portion 122. The fluid in the interior of the casing 110 may flow out of the casing 110 through the gap 105 as shown by the arrows. In yet another embodiment, casing bit or a sleeve attached to the casing bit may overlap the lower end of the casing, and the sealing member may be disposed in a recess of the casing bit or sleeve.

The sealing member 130 is axially movable in the recess 115 in response to fluid pressure. The sealing member 130 is configured to selectively seal against an external surface of the casing bit 120. In one embodiment, the sealing member may an elastomeric seal. An exemplary sealing member is an elastomeric FS seal, which may optionally include a bump surface for sealing contact and an optional curved recess on the back of the seal to control the amount of compression. The curve recess allows the seal to deflect outward when sealing against a larger diameter surface. In one embodiment, the sealing member 130 has an inner diameter that is larger than the outer diameter of the non-raised portion 122. The inner diameter of the sealing member 130 is sufficiently sized to sealingly contact the raised portion 125 when the sealing member 130 is positioned adjacent the raised portion 125. The sealing member may optionally include an anti-extrusion spring to assist with maintaining its shape during compression.

During drilling, the internal pressure and/or the velocity of the fluid flowing through the gap 105 forces the sealing member 130 downward in the recess 115, as shown in FIG. 2. For example, the internal pressure may be greater than the hydrostatic pressure in the annulus. FIG. 2 shows the sealing member 130 is located adjacent the non-raised portion 122 of the casing bit 120. In this position, the sealing member 130 does not contact the rotating casing bit 120. As a result, fluid is free to bypass the sealing member 130 and exit the gap 105 and the casing 110. Because the sealing member 130 is not in contact with the casing bit 120, the sealing member 130 is prevented from wear when the casing bit 120 is rotating during the drilling process.

After drilling and pumping the cement, u-tubing pressure and annulus pressure may force fluid to enter the casing 110 via gap 105, as shown by the arrows in FIG. 3. The sealing member 130 is configured to move upward in the recess 115 in response to these upward pressures, as shown in FIG. 3. Movement of the sealing member 130 in the recess 115 may be referred to as "floating." In this upper position, the sealing member 130 is located adjacent the raised portion 125. The inner diameter of the sealing member 130 is sized to contact the raised portion 125, thereby sealing off fluid flow through the gap 105. In this manner, fluid, such as cement, outside of the casing 110 may be prevented by the sealing assembly from entering the casing 110 through the gap 105.

Figure 4:
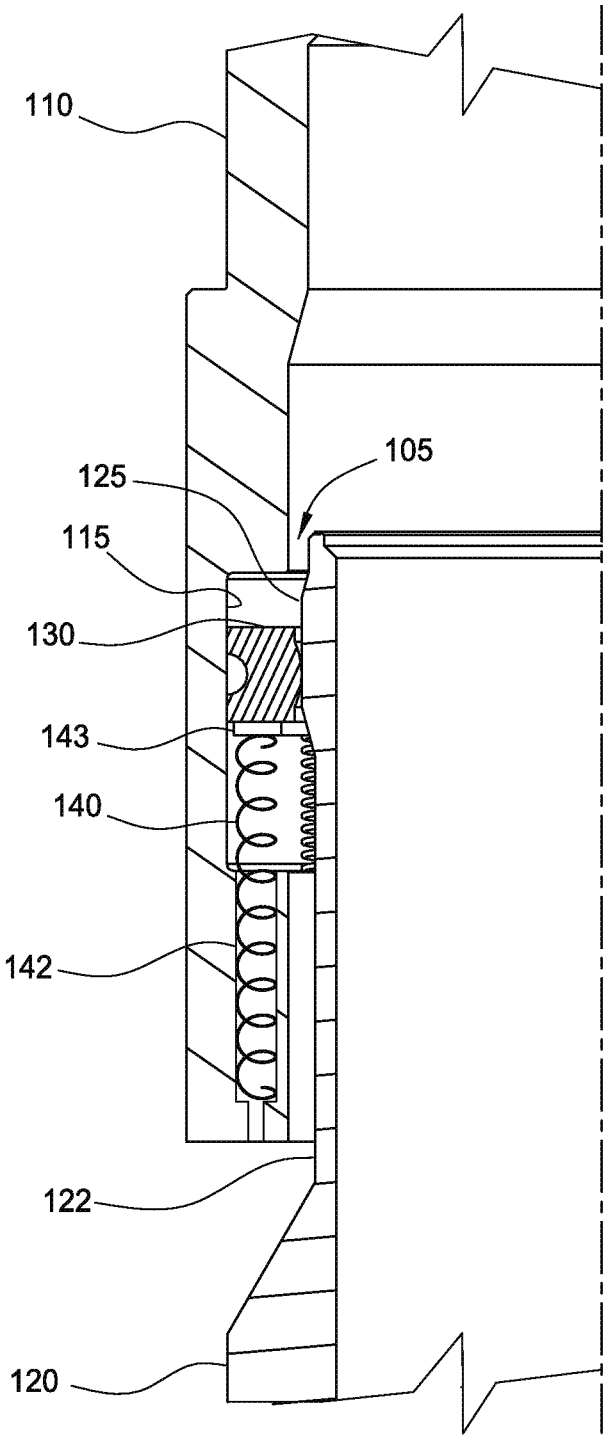
FIGS. 4-6 illustrate another embodiment of a sealing assembly for sealing between two tubulars.

FIG. 4 illustrates another embodiment of the seal assembly, which is equipped with an optional biasing member 140 to bias the sealing member 130 against the seal surface. As shown, the lower end of the casing 110 includes a bore 142 for receiving the biasing member 140. An exemplary biasing member is a spring. The spring 140 is configured to bias the sealing member 130 in the upper position for sealing contact with the raised portion 125. The spring 140 may include an optional ring or plate 143 for supporting the sealing member 130.

Figure 5:
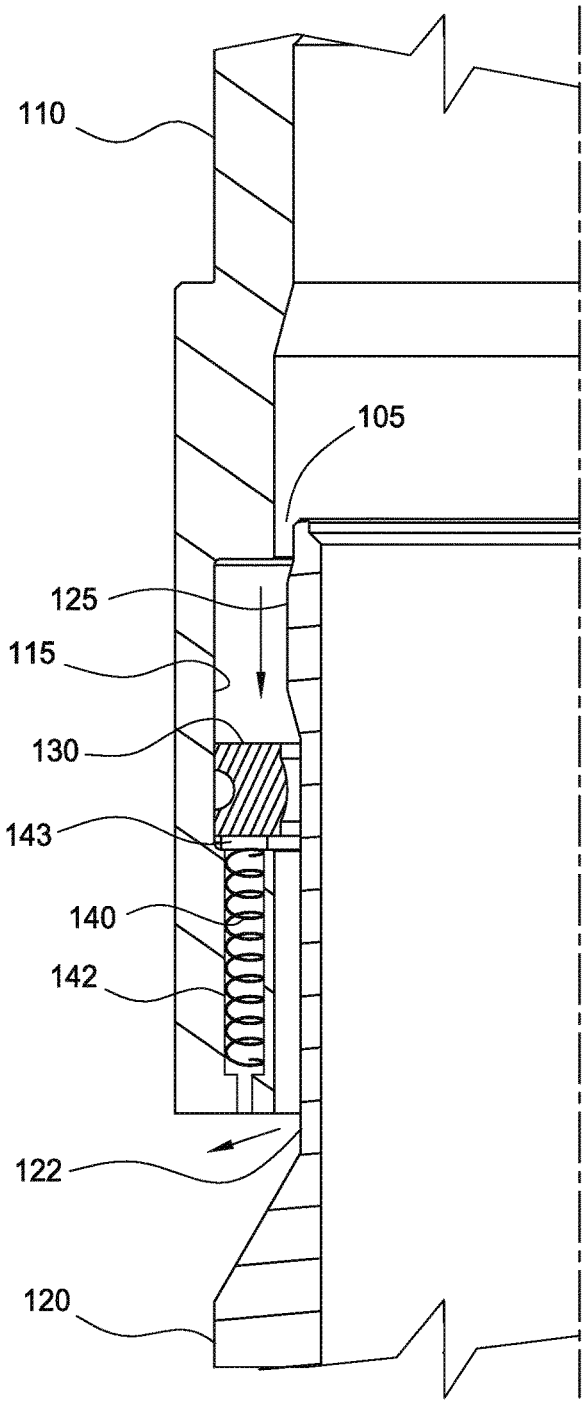

During pumping of a drilling fluid or cement, the fluid pressure compresses the spring 140, as shown in FIG. 5. As such, the sealing member 130 is lowered and positioned adjacent the non-raised portion 122 of the casing bit 120. In this lowered position, the sealing member 130 does not contact the rotating casing bit 120. As a result, fluid is free to bypass the sealing member 130 and exit the gap 105 and the casing 110, as shown by the arrows.

After drilling and pumping the cement, the spring 140 biases the sealing member 130 upward, thereby returning the sealing member 130 into sealing contact with the raised portion 125, as illustrated in FIG. 4.

Figure 6:
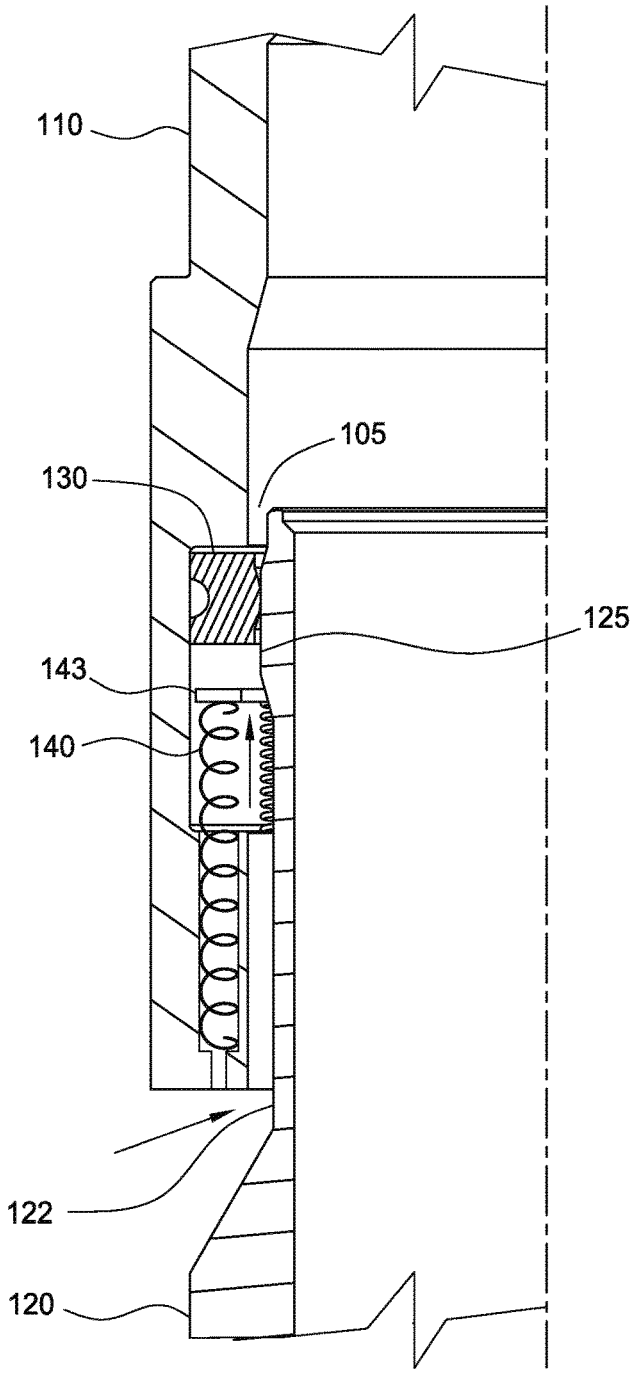

Additionally, u-tubing pressure and annulus pressure may force fluid to enter the casing 110 via gap 105, as shown by the arrows in FIG. 6. The sealing member 130 is urged upward in the recess 115 in response to these upward pressures. As illustrated in FIG. 6, the fluid pressure has moved the sealing member 130 further up the raised portion 125. In one embodiment, this upward movement may cause the sealing member 130 to move away from the spring 140 and the support ring 143, while maintaining sealing contact with the raised portion 125. In this manner, fluid, such as cement, outside of the casing 110 may be prevented from entering casing 110 through the gap 105 by the sealing assembly.

Figure 7:
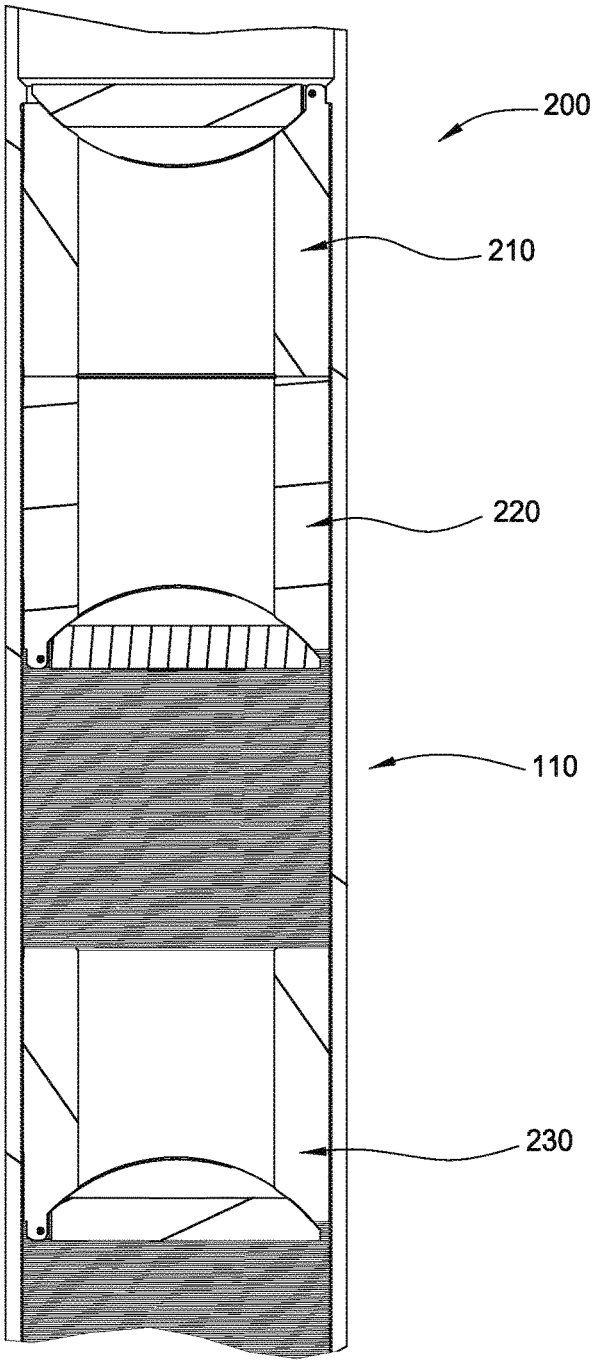
FIGS. 7-9 illustrate an embodiment of an arrangement of one way valves in a tubular.

In another embodiment, the drilling assembly may include two or more one way valves positioned in opposite directions to control fluid flow through the drilling assembly. FIG. 7 shows an arrangement of one way valves disposed in a tubular, such as casing 110. The arrangement includes a first one way valve 210 for preventing fluid flow in the downward direction when closed and a second one way valve 220 for preventing fluid flow in the upward direction when closed. An optional third one way valve 230 may be included in the arrangement. In this embodiment, the third one way valve 230 is configured to prevent fluid flow in the upward direction when closed. Any suitable one way valves may be used. An exemplary one way valve is a flapper valve. It must be noted that the positions of the second and third one way valves 220, 230 are interchangeable. Also, it is contemplated that the third one way 230 may be used without the second one way valve 220.

Figure 8:
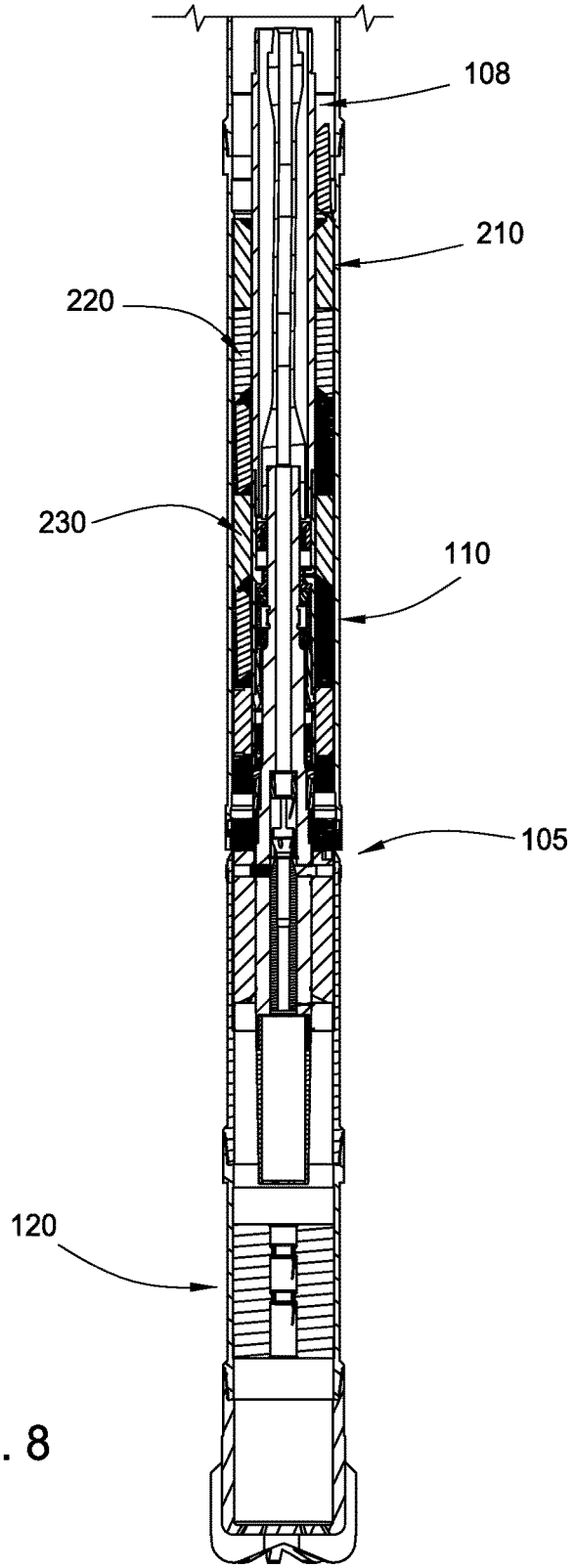

FIG. 8 shows the casing string 110 of the drilling system equipped with the one way valve arrangement of FIG. 7. In this embodiment, all of the valves 210-230 are positioned above the gap 105 between the casing 110 and the casing bit 120. During drilling, the valves 210-230 are retained in the open position by the motor 108.

Figure 9:
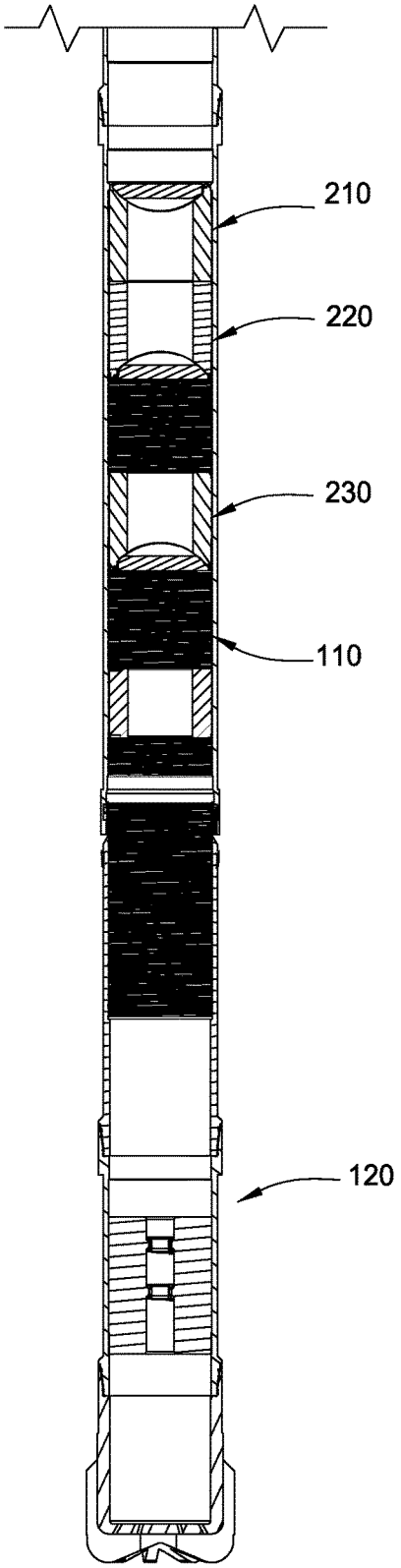

After drilling and pumping the cement, the motor 108 is retrieved from the casing string 110. FIG. 9 shows the valves 210-230 in the closed position after removal of the motor 108. In this respect, the second and third valves 220, 230 may be used to prevent upward movement of a fluid, such as cement, in the casing string 110. The valves 220, 230 may be used in combination with the sealing member 130 in the recess 115 to prevent u-tubing of the cement.

The first valve 210 may be used to facilitate a pressure test after the cementing process. As discussed above, the first valve 210 closes after the motor 108 is removed, as shown in FIG. 9. In the closed position, the first valve 210 allows the pressure to build in the casing string 110 to allow testing of the casing string 110 for leaks.

In another embodiment, the casing 110 may be positioned at the desired depth by determining the desired depth of the casing bit using routine methodology. Then, the casing is drilled until the gap 105 is positioned at the desired depth. In this respect, the casing bit will be positioned below the desired depth.

In one embodiment, a method of controlling fluid flow between two tubulars includes disposing a sealing member in an annular area between two tubulars, wherein the two tubulars partially overlap; moving the sealing member to a lower position where it is not in contact with one of the tubulars, thereby allowing fluid flow through the annular area; and moving the sealing member to an upper position where it is in contact with both of the tubulars, thereby preventing fluid flow through the annular area.

In one or more of the embodiments described herein, the sealing member is moved in response to fluid pressure.

In one or more of the embodiments described herein, one of the tubulars includes a surface having a raised portion and a non-raised portion.

In one or more of the embodiments described herein, the sealing member is in contact with the raised portion when it is in the upper position.

In one or more of the embodiments described herein, the sealing member is not in contact with the non-raised portion when it is in the lower position.

In one or more of the embodiments described herein, the method includes biasing the sealing member in the upper position.

In another embodiment, a sealing assembly includes: a first tubular having a recess; a second tubular having a raised portion and partially overlapping the first tubular; a sealing member disposed in the recess and between the first tubular and the second tubular, wherein the sealing member is movable in the recess between a lower position and an upper position, where in the upper position, the sealing member is in contact with the raised portion to prevent fluid flow between the tubulars, and where in the lower position, the sealing member is not in contact with the raised portion to allow fluid flow between the tubulars.

In one or more of the embodiments described herein, the sealing assembly includes a biasing member for biasing the sealing member in the upper position.

In one or more of the embodiments described herein, the sealing assembly comprises an elastomeric seal.

In one or more of the embodiments described herein, the sealing assembly comprises a FS seal.

In another embodiment, a valve arrangement in a tubular includes a first one way valve configured to prevent fluid flow in the tubular in a first direction; and a second one way valve configured to prevent fluid flow in the tubular in a second, opposite direction.

In one or more of the embodiments described herein, the first and second valves are disposed above an opening in the tubular.

In one or more of the embodiments described herein, the opening comprises a gap between two tubulars.

In one or more of the embodiments described herein, the first direction is a downward direction.

In one or more of the embodiments described herein, a third one way valve may be used. In one or more of the embodiments described herein, the third one way valve prevents fluid flow in the second direction.

In one or more of the embodiments described herein, at least one of the one way valves comprises a flapper valve.

In another embodiment, a method of completing a wellbore includes providing a tubular having a first one way valve configured to prevent fluid flow in the tubular in a first direction and a second one way valve configured to prevent fluid flow in the tubular in a second, opposite direction; supplying a cement through the first and second valves and out of the tubular; closing the second one way valve to prevent cement from returning into the tubular; and closing the first one way valve and applying pressure above the first one way valve.

In one or more of the embodiments described herein, the pressure is applied to test for leaks in the tubular.

In one or more of the embodiments described herein, the method includes maintaining the first and second one way valves in the open position during a drilling operation.

In one or more of the embodiments described herein, the valves are maintained opened using a drill string connected to a motor.

While the foregoing is directed to embodiments of the present invention, other and further embodiments of the invention may be devised without departing from the basic scope thereof, and the scope thereof is determined by the claims that follow.

The invention claimed is:

1. A method of controlling fluid flow between two tubulars, comprising;

disposing a sealing member in an annular area between a first tubular and a second tubular;

rotating the first tubular relative to the second tubular downhole: moving the sealing member to a lower position where it is not in contact with one of the tubulars, thereby allowing fluid flow from an interior of the first tubular to an exterior of the second tubular, wherein the sealing member is moved in response to fluid pressure acting on the sealing member; and moving the sealing member to an upper position where it is in contact with both of the tubulars, thereby preventing fluid flow through the annular area.

2. The method claim 1, wherein one of the tubulars includes a surface having a raised portion and a non-raised portion.

3. The method of claim 2, wherein the sealing member is in contact with the raised portion when it is in the upper position.

4. The method of claim 2, wherein the sealing member is not in contact with the non-raised portion when it is in the lower position.

5. The method of claim 1, further comprising biasing the sealing member in the upper position.

6. The method of claim 1, wherein moving the sealing member to a lower position comprises supplying fluid to move the sealing member to the lower position, thereby allowing the fluid to flow out of the first tubular and the second tubular via the annular area.

7. The method of claim 6, wherein moving the sealing member to the upper position comprises stopping or reducing fluid flow sufficiently to allow the sealing member to move to the upper position.

8. A sealing assembly, comprising: a first tubular having a recess;

a second tubular having a raised portion and partially overlapping the first tubular, wherein the second tubular is rotatable relative to the first tubular downhole;

a sealing member disposed in the recess and between the first tubular and the second tubular, wherein the sealing member is movable in the recess between a lower position and an upper position, wherein the sealing member is movable in response to fluid pressure acting on the sealing member, where in the upper position, the sealing member is in contact with the raised portion to prevent fluid flow between the tubulars, and where in the lower position, the sealing member is not in contact with the raised portion to allow fluid flow from an interior of the first tubular to an exterior of the second tubular.

9. The sealing assembly of claim 8, further comprising a biasing member for biasing the sealing member in the upper position.

10. The sealing assembly of claim 8, wherein the sealing assembly comprises an elastomeric seal.

11. The sealing assembly of claim 8, wherein the sealing assembly comprises a seal having a bump surface for sealing contact and a curved recess on a back surface of the seal.

* * * * *